United States Patent [19]

Hultberg

[11] 4,222,623

[45] Sep. 16, 1980

[54] GLOW-LAMP HOLDER

[76] Inventor: Tore Hultberg, Hulie, S-340 14 Lagan, Sweden

[21] Appl. No.: 927,986

[22] Filed: Jul. 26, 1978

[51] Int. Cl.[2] ..... H01R 13/44

[52] U.S. Cl. ..... 339/34; 339/151 R; 339/154 L; 339/156 T; 339/176 R; 362/376; 362/382

[58] Field of Search ..... 362/376, 382, 226; 339/151, 154, 176 L, 156, 34, 176

[56] References Cited

U.S. PATENT DOCUMENTS 3,579,171 5/1971 Woodward ..... 339/176 L

*Primary Examiner*—Stephen J. Lechert, Jr.

*Attorney, Agent, or Firm*—Howson and Howson

[57] ABSTRACT

This invention relates to a holder for a glow-lamp or a bulb and comprises internally in said holder a switch mechanism which on its side facing the bulb has contacts for providing electric contact with the contact surfaces of the lamp base, and which has terminals for the conductors connected to the holder, the electric connection between the terminals and the contacts being interruptable when removing the bulb from the holder.

6 Claims, 7 Drawing Figures

GLOW-LAMP HOLDER

Child-proof wall sockets and other safety devices for domestic electrical apparatuses have been increasingly frequent. However, a remaining risk is represented by the conventional lamp holder commonly used in many homes of today. When the bulb is removed from the holder there is a great risk to tuch by one's fingers the electric conducting details of the holder which could be alive irrespectively of if the bulb is screwed into the holder or not, and further more irrespectively of in what position a switch possibly connected to the holder is left.

A previously known holder of the kind mentioned above is designed in such a way that those contacts being intended for contacting the contact surfaces of the lamp base are displaced axially upwardly by means of spring devices in the same direction as the moving direction of the lamp base when the lamp base is removed from the holder. When removing the lamp base from such a lamp holder the electric connection between the contacts and the terminals for the conductors connected to the lamp holder is interrupted. However, this lamp holder presents the risk that it is very simple to unintentedly depress the contacts so that they will be brought into elctric connection with the terminals and thus the electric line.

Therefore, this inventions has for its object to provide a lamp holder of the kind mentioned above which lamp holder is designed in such a way that the electric connection between the electric line and the contacts provided at the bottom of the lamp holder automatically is interrupted when the lamp is removed from the lamp holder and in such a way that it is impossible to unintentedly bring these contacts to a conducting connection with the electric line.

According to the invention this object is achieved in that the switching mechanism of a lamp holder comprises a main portion mounted stationary in the lamp holder and provided with the terminals and a relatively this main portion moveable contact supporting portion carrying said contacts, the contact supporting portion, when mounting a lamp into the lamp holder, being moveable to a working position in which electric connection exists between the terminals and the contacts and, when removing the lamp from the lamp holder, being moveable to an ineffective position in which this connection is interrupted.

In a preferred embodiment of the lamp holder according to the invention each of the contact supporting portion and the main portion on their sides facing each other are provided with switching means having electric connection with one contact each and one terminal each respectively, the switching means being in pairs moveable to engament with each other when moving the contact supporting portion to the working position.

In one embodiment of the invention the contact supporting portion is provided turnable in the main portion and in another embodiment of the invention the contact supporting portion is provided displaceable perpendicularly to the direction of introducing the lamp into the lamp holder.

Further, according to the invention, a lamp holder comprises a locking pin, which by means of a spring is introduceable into a locking aperture and which can be brought out of this aperture under influence of a stud engaged by the lamp base, a relative movement between the contact supporting portion and the main portion being impossible when the locking pin is engaged in the locking aperture.

To ensure an electric contact between the contacts and the terminals there must, according to the invention, be performed two different movements, namely in the first embodiment a turning of the contact supporting portion and a depressing of the stud acting on the locking pin, and in the second embodiment a lateral displaceing of the contact supporting portion and a depressing of that stud acting on the locking pin.

The invention will be described more in detail below under reference to the attached drawings.

On the drawings

Figure 1:
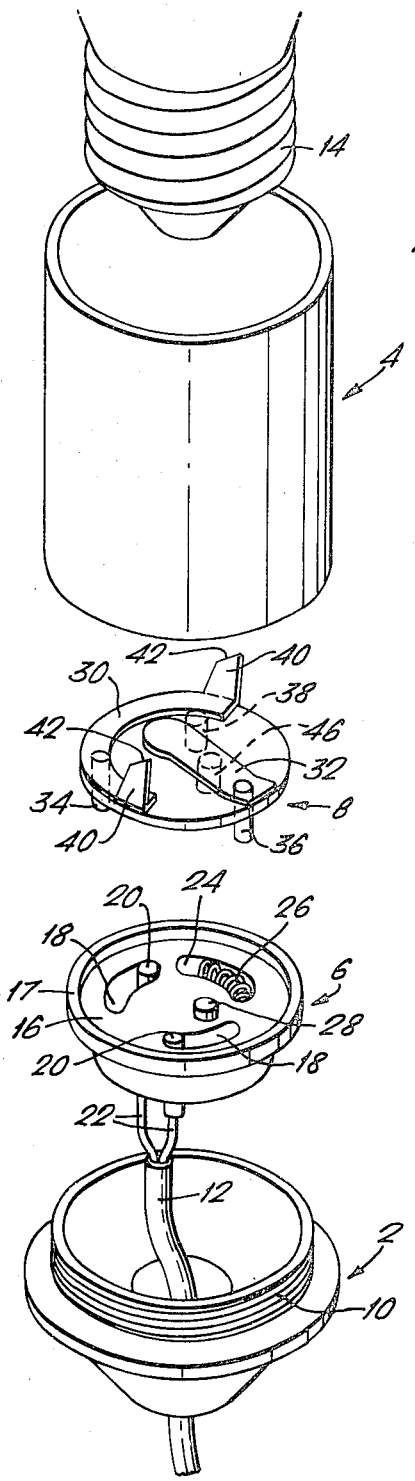
FIG. 1 shows a lamp holder and a first embodiment of the inventive device.

The lamp holder according to the invention comprises a bottom portion 2, a sleeve portion 4 and a switching mechanism which according to the invention consists of two portions 6 and 8. In mounted condition of the lamp holder the upper portion 8 of the switching mechanism is mounted on the lower portion 6 of the switching mechanism. The switching mechanism is as a unit provided in the upper portion of the bottom portion 2 of the lamp holder and the sleeve portion thereof is threaded onto a thread 10 of the bottom portion. An electric wire 12 is connected to the lamp holder and in the figure there is also shown a lamp base 14 for being screwed into the sleeve portion 4.

Figure 2:
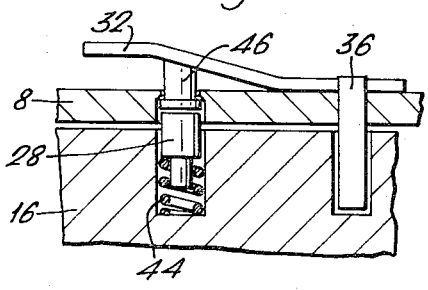
FIG. 2 shows a partial sectional view of the switching mechanism of the lamp holder.

In the first embodiment which is shown in FIGS. 1 and 2 the lower portion 6 of the switching mechanism comprises a substantially disc-shaped main portion 16 having a protruding rim portion 17. The main portion 16 has bow-shaped recesses 18 and at one end of these recesses there are provided switching means 20. The switching means 20 extend through the main portion 16 to the lower side thereof and are connected to the conducters 22 of the electric wire 12. In a further recess 24 in the main portion 16 there is provided a return spring 26, the purpose of which will be described below. The main portion 16 further has a locking pin provided as a spring-loaded pin 28 which is protruding from the upper side of the main portion, but which could be depressed into the main portion against the action of the spring 44.

The upper portion 8 of the switching device has the shape of a circular disc sized in such a way that it is accepted in the recess defined by the rim portion 17 of the main portion. When accepten in the main portion 16 the upper portion 8 of the contact supporting portion is turnable relatively the main portion 16 and the contact supporting portion 8 is guided by having its circumferential surface egageing the inner edge of the rim portion 17. In order to enhance the turnability of the contact supporting portion 8 it is possible to provide on it a central stud (not shown) engageing a fitting aperture (not shown) in the main portion 16. The contact supporting portion 8 is provided with two contacts 30 and 32, these contacts being rigidly secured to the contact supporting portion 8 and having electric connection with pins or switching means 34 and 36 which are protruding from the lower side of the contact supporting portion 8. When in assembled condition the pins 34 and 36 are engageing recesses 18 in the main portion 16 and it is evident that by turning the contact supporting portion 8 in a clockwise direction it is possible to establish electric connection between the contacts 30 and 32 and switching means 20 by having the switching pins 34 and 36 engageing the switching means 20. When turning the contact supporting portion 8 in an anti-clockwise direction the switching pins 34 and 36 are brought free from the switching means 20, the contacts 30 and 32 in this position being isolated from the conductors 22.

A pin 38 protruding from the lower side of the contact supporting portion 8 is accepted in a recess 24 in the main portion 16 and is engageing the free end of a return spring 26. When turning the contact supporting portion 8 in a clockwise direction relatively to the main portion 16, the spring 26 will be compressed in the recess 24 under influence of the pin 38. In the position where the contacts 30 and 32 are alive by being connected to the switching means 20 via the switching pins 34 and 36 the return spring 26 has a tendency to turn the contact supporting portion 8 in an anti-clockwise direction to the position in which the contacts 30 and 32 are isolated from the conducters 22. Thus, when the lamp holder is assembled and is not exposed to any force acting in a clockwise directing the contact supporting portion 8 under influence of the spring 26 has a position in which the switching pins 34 and 36 are free from the switching means 20 so that the contacts 30 and 32 are isolated from the conducters 22.

The contact 30 is provided with two arms 40 directed upwardly and having points 42 which, when screwing the lamp base 14 into the lamp holder, will engage the lamp base. When turning the lamp base the contact 30 will transmit a turning motion to the contact supporting portion 8 which is turned to the position in which the switching means are engageing each other.

To further guarantee that the contacts 32 and 30 are not alive when the lamp base 14 is removed from the lamp holder, the lamp holder is provided with a locking device most clearly shown in FIG. 2. In the main portion 16 there is provided a locking pin 28 as mentioned above. The locking pin 28 is spring-loaded by means of a spring 44 urging the locking pin 28 upwardly. When turned in a anti-clockwise direction to the position occupied when the lamp base 14 is removed from the lamp holder, the locking pin 28 will be aligning a pin 46 provided in an opening in the contact supporting portion 8. The pin 46 is situated under the contact 32 designed as a spring arm. In the position shown in FIG. 2 which is the position where the switching means are not in conductive connection with each other, the locking pin 28 is protruding into the opening in the contact supporting portion 8, which opening is accepting a pin 46 so that the contact supporting portion 8 is locked against turning. When screwing a lamp base into the lamp holder, the contact 32 is depressed at the free end thereof so that the locking pin 28 is depressed by means of the pin 46 into the main portion and the locking engagement of the locking pin 28 with the contact supporting portion 8 will be interrupted. Thus, when the lamp base is screwed into the lamp holder, the locking action of the locking pin is discontinued so that the contact supporting portion 8 can be turned in a clockwise direction to the position in which the switching means have conductive engagement with each other. The locking device shown in FIG. 2 is a safety device making it impossible to move the contact supporting portion to a position where the contacts 30 and 32 become alive when the lamp base is removed from the lamp holder.

Figure 3:
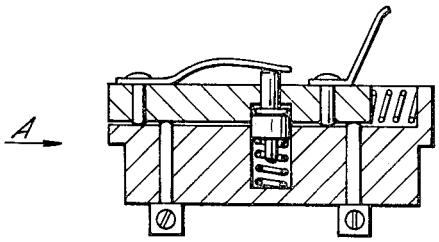
FIG. 3 shows a sectional view along the lines B—B i FIG. 4, a second embodiment of the lamp holder being shown.
Figure 4:
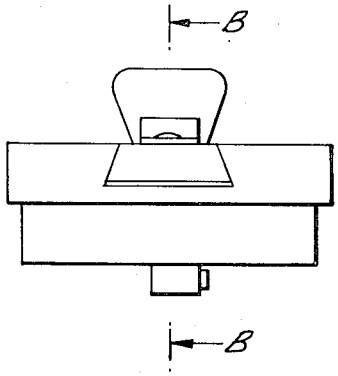
FIG. 4 shows a switching device according to FIG. 3 seen in the direction of arrow A in FIG. 3.

In FIGS. 3 and 4 there are shown a second embodiment of the switching device of the lamp holder according to the invention. In this embodiment the contact supporting portion 8 is not turnable relatively to the main portion 16 but is accepted in an undercut groove 19. Thus, the contact supporting portion is displaceable in a direction perpendicular to the direction in which the lamp base 14 is introduced into the lamp holder. As is apparent from FIG. 3 the contact supporting portion is of shorter length than the undercut groove 19, which has one of its ends closed. Between the contact supporting portion 8 and the closed end of the groove 19 there is provided a return spring 26. On the upper side of the contact supporting portion 8 there is provided a contact 32 which is designed as a metal arm made from spring material and which is intended for engageing the central contact of the lamp base 14. Further, on the upper side of the contact supporting portion there is provided a side contact 30 which is substantially rigid and which is intended for being brought to engagement with the side surface of the lower "corner" of the lamp base when the lamp base is introduced or screwed down into the lamp holder. The side contact 30 is apparent from FIG. 3 inclined so that the upper portion thereof has a greater distance to the axial central line of the lamp holder than is the case of its lower portion. Due to this the contact supporting portion 8 will be displaced against the action of the return spring 26 when introducing the lamp base 14 into the lamp holder. The fastening devices of the contact 32 and the side contact 30 as well are provided as through pins 36 and 34 respectively extending through the contact supporting portion 8 and having on the lower side of the contact supporting portion exposed contact surfaces. On the bottom surface of the undercut groove 19 in the main portion 6 there is provided switching means 20 having the same mutual distance as the switching pins 34 and 36. The switching means 20 are provided with contact surfaces protruding somewhat above the bottom surface of the undercut groove 19. These switching means 20 further have conductive connection to terminals 9 to which the conducters 22 are fastened. When introducing the lamp base into the lamp holder the contact supporting portion 8 will, as mentioned above, be displaced to the right in FIG. 3 so that the switching pins 34 and 36 will be brought to conductive engagement with the upper exposed ends of the two switching means 20.

As is the case in the embodiment of FIGS. 1 and 2 there is also in this embodiment provided a locking device for making it possible to unintentedly displacing the contact supporting portion 8. In principal, this locking device is designed in the same way as is apparent from FIG. 2 and therefore has a pin 46 which is depresseable by the central contact 32 which has the shape of a metal spring arm. The pin 46 depresses a locking pin 28 against the action of a spring 44. When the locking device is in the position shown in FIG. 3 the locking pin 28 makes it impossible to displace the contact supporting portion 8 by engageing the contact supporting portion 8 and the main portion 16 as well. When depressing the central contact 32 the locking pin 28 will be accepted only in the main portion 16 making the contact supporting portion 8 displaceable so that a conductive connection can be established between the switching pins 34 and 36 and the switching means 20.

Figure 5:
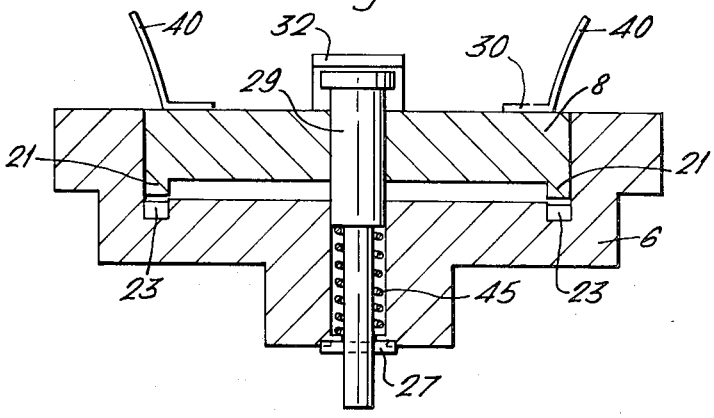
FIG. 5 is a sectional view showing a third embodiment of the switching device of the lamp holder.
Figure 6:
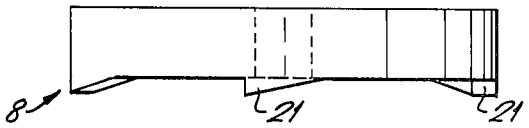
FIG. 6 shows a contact supporting portion of the switching device according to FIG. 5.
Figure 7:
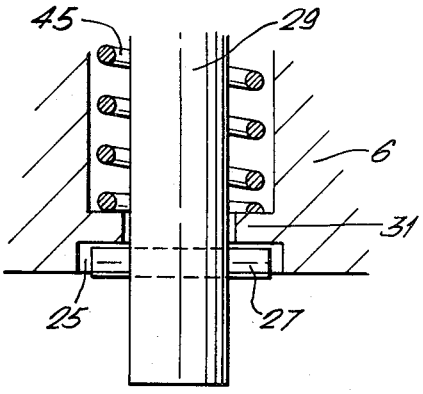
FIG. 7 is a partial sectional view of a locking device in the switching device according to FIG. 5.

In FIGS. 5–7 there is shown a third embodiment of the switching device of the lamp holder according to the invention. In this embodiment the contact supporting portion 8 is as is the case in the embodiment according to FIGS. 1 and 2 accepted turnably in a circular recess in the upper side of the main portion 16. Along the periphery of the bottom of the recess there is provided a notch with a rectangular cross section and in this notch there is provided at equal distances a number, for example 4, wedge-shaped projections 23 each having one inclined surface and one surface being parallel to an axial plane through the lamp holder. The height of these projections is preferably aproximately the same as the depth of the notch. At the periphery of the lower side of the contact supporting portion 8 there is provided corresponding downwardly directed wedge-shaped projections 21 which are directed opposite to those of the projections 23. The projections 21 and 23 have same mutual distances so that the inclined surfaces of the projections can be brought to engage each other. When axially depressing the contact supporting portion 8 there will be created a turning movement of the contact supporting portion due to the fact that the inclined surfaces of the projections 21 and 23 will slide against each other. As is the case in the embodiments described above, the contact supporting portion 8 on its upper side is provided with contacts 30 and 32 intended for engagement with the contact surfaces of the lamp base 14. These contacts 30 and 32 can have the design apparent from FIG. 1. Further, these contacts are connected to switching means which, by turning the contact supporting portion 8, are moveable to engagement with and conductive connection to corresponding switching means 20 on the main portion 16. These switching means 20 are not shown on the drawings, but could either be designed as is apparent from FIG. 1 or is apparent from FIG. 3.

Centrally through the contact supporting portion 8 and the main portion 16 as well is extending an axially displaceable stud 29 which on the upper side of the contact supporting portion 8 is provided with a head situated below the central contact 32, the central contact also in this embodiment being designed as a spring metal arm. The upper portion of the stud 29 is axially slideable, but unturnably accepted in an aperture in the contact supporting portion 8. This can be done by giving the upper portion of the stud 29 a cross section of elliptical, square or some other suitable shape. The lower portion of the stud 29 is of circular cross section and has considerably less diameter than the distance across the upper portion of the stud so that there is provided a shoulder against which engages a spring 45. The lower end of this spring 45 engages a second shoulder 31 at the lower end of the central aperture through the main portion 16. The spring 45 is acting for urging the stud 29 upwardly against the contact 32. The lower portion of the stud 29 has a laterally directed through hole for accepting a locking pin 27 extending perpendicular to the axial direction of the stud 29. On the lower side of the main portion 16 there is provided a narrow locking groove 25, into which the locking pin 27 is introduceable. When the locking pin 27 is engaged in the locking notch it renders turning of the stud 29 impossible so that also turning of the contact supporting portion 8 is impossible relatively to the main portion 16. To permit turning of the contact supporting portion 8 the central contact 32 must be depressed so that the stud 29 is displaced downwardly and the locking pin 27 is brought to a position free from the locking notch 25. Also in this embodiment there is made impossible unintentional turning of the contact supporting portion 8 to such a position that the contacts 30 and 32 can be connected to the electric net.

To make possible automatic return movement of the contact supporting portion to its non-working position in which the electric connection between the terminals 9 and the contacts 30 and 32 is interrupted there is also in the embodiment according to FIGS. 5–7 provided a return spring which could be provided in the same way as is shown in FIG. 1. The return spring can also be provided in such a way that one of its ends is engageing one surface of one of the wedge-shaped projections 21 of the contact supporting portion 8, said surface being parallel to an axial plane through the lamp holder. If this is the case, the return spring is accepted in the notch in the main portion 16, and the second end of said spring is engageing a suitable stop provided in this notch.

All the described embodiments give good guarantee that none of the contacts 30 and 32 can be connected to the electric net when no lamp is mounted in the lamp holder. This good guarantee is offered by the fact that two different parts of the lamp holder must be moved in two different ways to make it possible to establish electric contact. These two movements are automatically carried out when introducing a lamp base into the lamp holder, said lamp holder can be designed as a conventional lamp holder or as a bayonet lamp holder.

I claim:

1. In a lamp holder containing an automatic switch mechanism having, on the face thereof facing the lamp, contacts for providing electrical contact with the contact surfaces of the base of the lamp and having terminals for connection to the conductors supplying current to the lamp, said switch mechanism operating automatically to interrupt the electrical connection between said terminals and said contacts in response to removal of said lamp from said holder and to close said electrical connection in response to insertion of said lamp into said lamp holder, the improvement wherein:

said switch mechanism comprising a main portion which is stationarily mounted in said lamp holder and on which said terminals are mounted, and a contact supporting portion on which said contacts are mounted;

said contact supporting portion being movable relative to said main portion between a working position in which electrical connection is made between said terminals and said contacts and an ineffective position in which said connection is interrupted;

means holding said contact supporting portion in said ineffective position when said lamp is removed; and means secured to said contact supporting portion and responsive to insertion of said lamp into said lamp holder to move said contact supporting portion into said working position.

2. The lamp holder of claim 1, wherein said contact supporting portion and said main portion each comprise a pair of switching means at the mutually confronting surfaces thereof which are spaced apart from each other when said lamp is removed, and positioned so that each switching means of each of said pairs is moved into engagement with a corresponding one of the other of said pairs when said contact supporting portion is moved into said working position.

3. The lamp holder of claim 2, wherein said contacting portion is rotatable with respect to said main portion from said ineffective position to said working position in response to insertion of said lamp into said holder.

4. The lamp holder of claim 3, wherein said means for holding said contact supporting portion in said ineffective position comprises a return spring acting between said contact supporting portion and said main portion of said switch mechanism, and wherein said contacts are configured to transmit torque from the base of said lamp to said contact supporting portion when said lamp is screwed into said holder.

5. The lamp holder of claim 4, wherein said main portion and said contact supporting portion are both provided with wedge-shaped projections on their confronting surfaces, said projections being responsive to axial depression of said contact supporting section against said main portion by said lamp base to exert a torque on said contact supporting portion about said axis.

6. The lamp holder of claims 4 or 5, comprising a locking pin and a locking notch, one on said contact supporting portion and one on said main portion and positioned so that said pin is engagable in said notch when said contact supporting portion is in said ineffective position, said pin being removable from said notch in response to introduction of said lamp into said lamp holder.

* * * * *